US006149469A

United States Patent [19]

Kim

[11] Patent Number: 6,149,469

[45] Date of Patent: Nov. 21, 2000

[54] CONNECTOR ASSEMBLY

[75] Inventor: Jung-Ho Kim, Suwon, Rep. of Korea

[73] Assignee: SamSung Electronics Co., Ltd., Suwon, Rep. of Korea

[21] Appl. No.: 09/407,111

[22] Filed: Sep. 27, 1999

[30] Foreign Application Priority Data

Sep. 26, 1998 [KR] Rep. of Korea ..... 98-18434

[51] Int. Cl.[7] ..... H01R 24/04

[52] U.S. Cl. ..... 439/668; 439/669; 439/218; 439/939

[58] Field of Search ..... 439/668, 669, 439/638, 939, 218, 76.1

[56] References Cited

U.S. PATENT DOCUMENTS

| | | | |
|---|---|---|---|
| 3,771,098 | 11/1973 | Dempsey | 439/669 |
| 4,002,399 | 1/1977 | Deitch et al. | 439/638 |
| 4,367,001 | 1/1983 | Munakata | 439/638 |
| 4,420,216 | 12/1983 | Motoyama et al. | 439/669 |
| 4,803,728 | 2/1989 | Lueken | 439/638 |
| 4,957,454 | 9/1990 | Shichida | 439/544 |
| 5,137,469 | 8/1992 | Carpenter et al. | 439/578 |
| 5,217,395 | 6/1993 | Bailey et al. | 439/668 |
| 5,501,608 | 3/1996 | Scheer et al. | 439/218 |
| 5,788,509 | 8/1998 | Byers et al. | 439/61 |

*Primary Examiner*—Paula Bradley
*Assistant Examiner*—Tho D. Ta
*Attorney, Agent, or Firm*—Robert E. Bushnell, Esq.

[57] ABSTRACT

A connector assembly for connecting a coaxial cable with an audio board provided with a tuner function, includes a line-in jack provided in the audio board for receiving an audio input plug, a coaxial connector connected with the coaxial cable, and an adapter for electrically connecting the coaxial connector with the line-in jack. Preferably, the line-in jack has a plug insertion hole sequentially provided with a tuner input contact, audio input contacts and ground (GND) contact outwardly from the bottom of the plug insertion hole. The adapter includes a body part having two end parts, a post plug provided in one of the end parts so as to have contact zones for respectively contacting the tuner input contact and GND contact when inserted into the plug insertion hole, and a socket provided in the other end part to connect with the coaxial connector.

20 Claims, 3 Drawing Sheets

CONNECTOR ASSEMBLY

CLAIM OF PRIORITY

This application makes reference to, incorporates the same herein, and claims all benefits accruing under 35 U.S.C. §119 from my application CONNECTOR ASSEMBLY filed with the Korean Industrial Property Office on 26 Sep. 1998 and there duly assigned Serial No. 18434/1998.

BACKGROUND OF THE INVENTION

1. Field of The Invention

The present invention concerns a connector assembly, and more particularly a connector assembly for connecting a coaxial cable with an audio board of a computer system having a tuner function.

2. Background of the Invention

A conventional audio board of a computer usually includes a mic-in (microphone-input) jack, a line-out jack, a headphone-out jack and a line-in jack. In order to add a tuner function to the audio board, an additional socket is required to receive the tuner input. That is, the audio board must be provided with a tuner input socket to receive a coaxial connector connected to a coaxial cable. This requires a change in the structure of the existing bracket, increasing the production cost. Further, the bracket of such an audio board is so limited in space that an additional connector may not be easily provided.

SUMMARY OF THE INVENTION

It is therefore an object of the present invention to provide an improved audio board for a computer.

It is a further object of the invention to provide an improved connector assembly for an audio board.

It is a yet further object of the invention to provide a connector assembly for an audio board which can be used with an existing jack bracket.

It is a still further object of the invention to provide a connector assembly which can be used for both audio stereo input or tuner input.

According to an embodiment of the present invention, a connector assembly for connecting a coaxial cable with an audio board provided with a tuner function, includes a line-in jack provided the audio board for receiving an audio input plug, a coaxial connector connected with the coaxial cable, and an adapter for electrically connecting the coaxial connector with the line-in jack. Preferably, the line-injack has a plug insertion hole sequentially provided with a tuner input contact, audio input contacts and ground (GND) contact outwardly from the bottom of the plug insertion hole. The adapter includes a body part having two end parts, a post plug provided in one of the end parts so as to have contact zones for respectively contacting the tuner input contact and GND contact when inserted into the plug insertion hole, and a socket provided in the other end part to connect with the coaxial connector.

The present invention will now be described more specifically with reference to the drawings attached only by way of example.

BRIEF DESCRIPTION OF THE ATTACHED DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
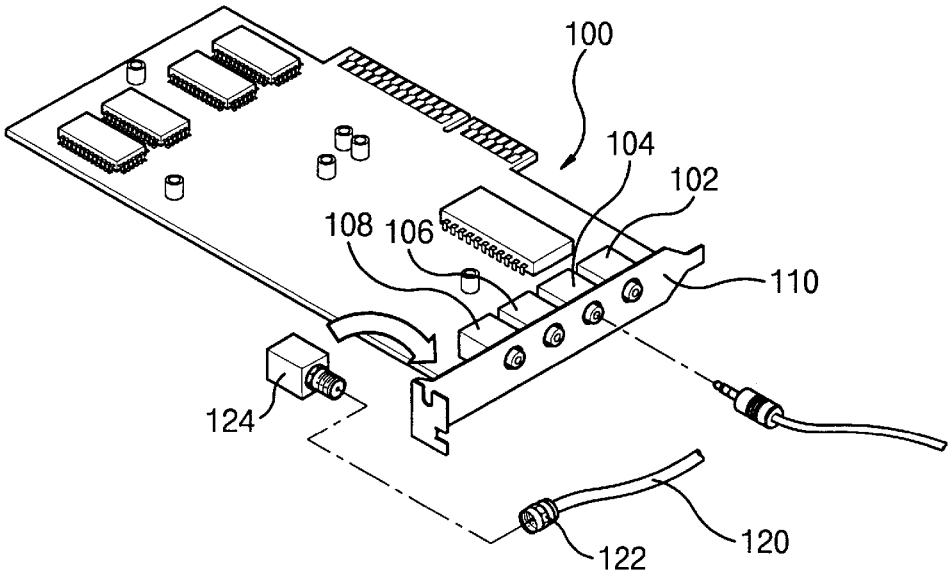
Fig. 1 (Prior Art)
FIG. 1 is a perspective view of a conventional audio board of a computer system.

Turning now to the drawings, in FIG. 1, the conventional audio board discussed earlier usually includes a mic-in (microphone-input) jack 102, line-out jack 104, headphone-out jack 106 and line-in jack 108. In order to add a tuner function to the audio board 100, an additional socket 124 is required to receive the tuner input. That is, the audio board 100 should be provided with the tuner input socket 124 to receive a coaxial connector 122 connected to a coaxial cable 120. This requires a change in the structure of the existing bracket 110, increasing the production cost. Further, the bracket of the audio board is so limited in space that an additional connector may not be easily provided.

Figure 2:
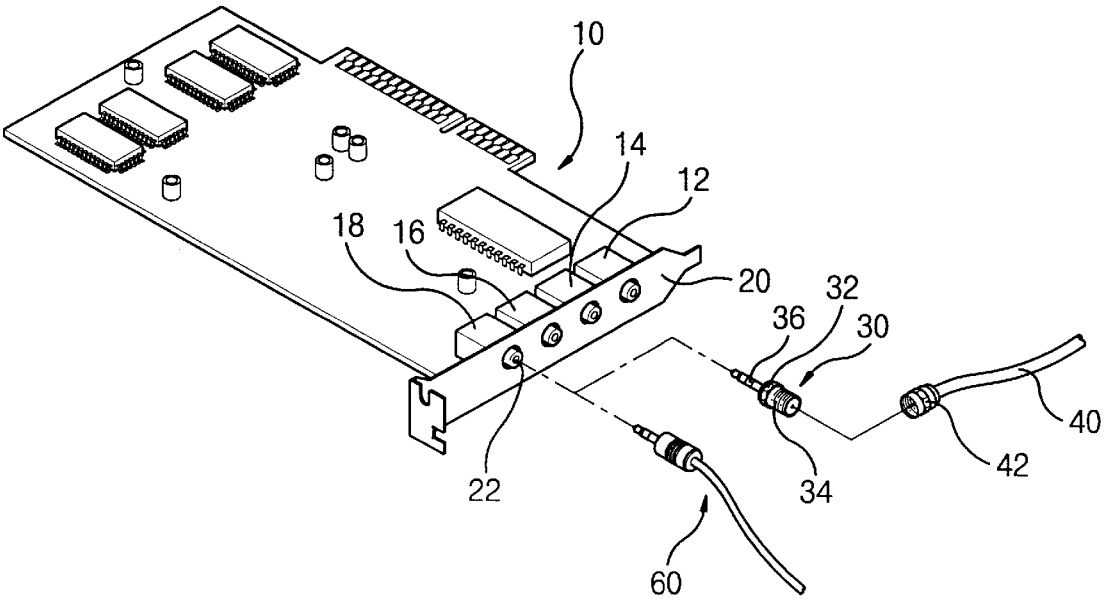
FIG. 2 is a perspective view for illustrating a connector assembly according to the present invention.
Figure 3:
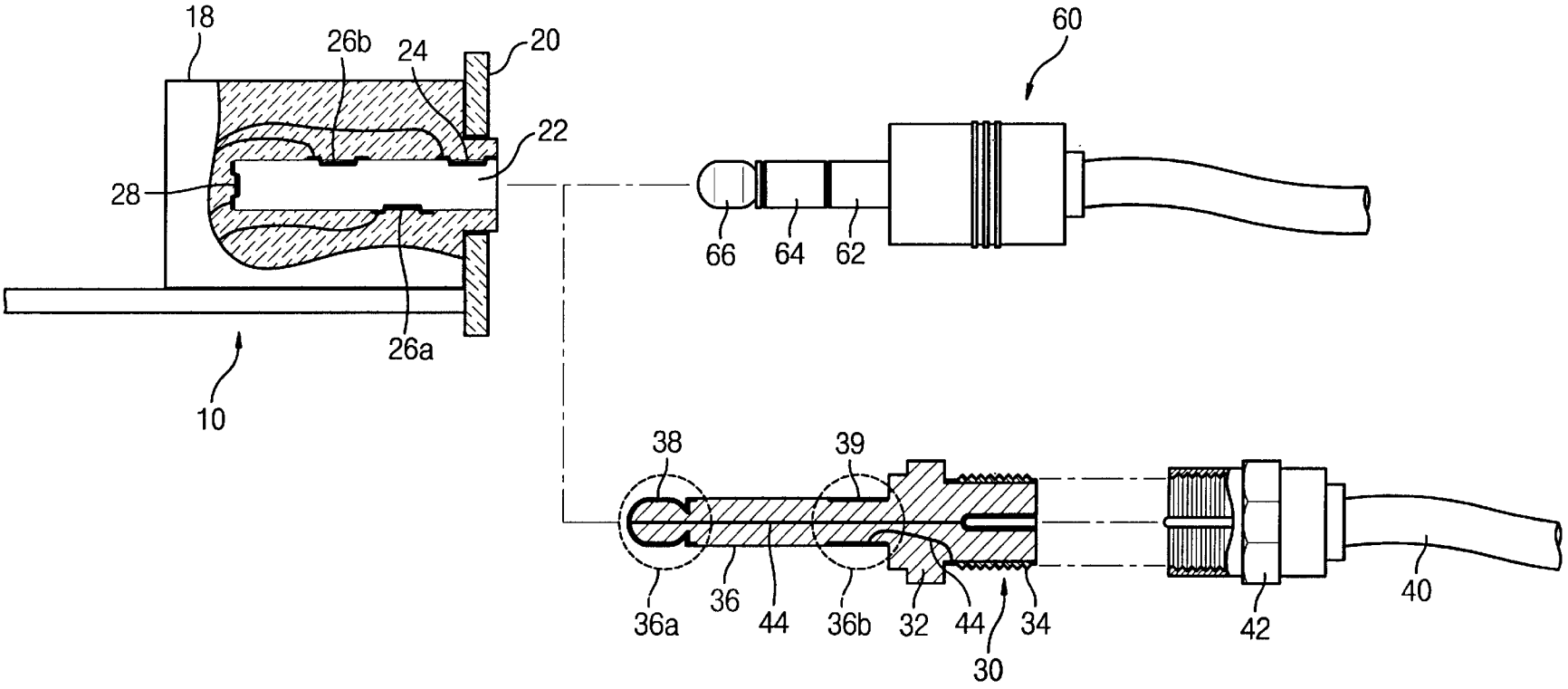
FIG. 3 illustrates cross sectional views of the inventive connector assembly.

The present invention will now be described with reference to the drawings. Referring to FIGS. 2 and 3, the inventive connector assembly includes line-in jack 18, coaxial connector 42, and adapter 30. The line-in jack 18 is provided in an audio board 10, which further includes an mic-in jack 12, line-out jack 14, headphone-out jack 16, and bracket 20. The line-in jack 18 is a common jack for receiving both audio stereo input and tuner input. That is, the common line-in jack can be used for two separate inputs. To this end, the line-in jack 18 includes audio input contacts 26*a,* 26*b* to receive the right and left audio stereo inputs, ground (GND) contact 24, and an additional tuner input contact 28 to receive the tuner input, as show in FIG. 3. This contact 28 is formed in the plug insertion hole or sleeve 22 of the line-in jack 18. The tuner input contact 28 is formed in the bottom of the plug insertion hole 22. These contacts 24, 26*a,* 26*b,* 28 are preferably positioned spaced from one another.

Figure 4A:
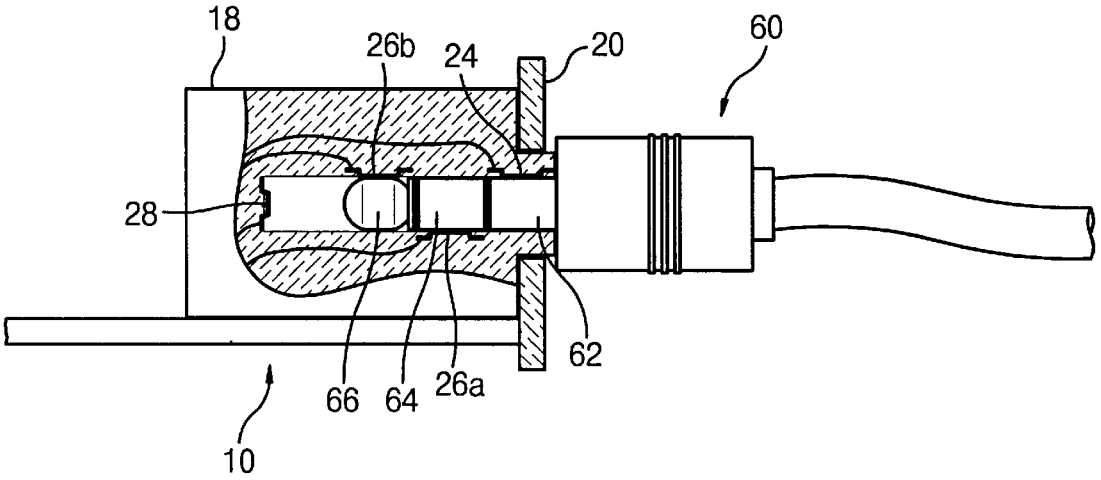
FIG. 4A is a partially cross sectional view for illustrating an audio input plug inserted into the line-in jack of an audio board.
Figure 4B:
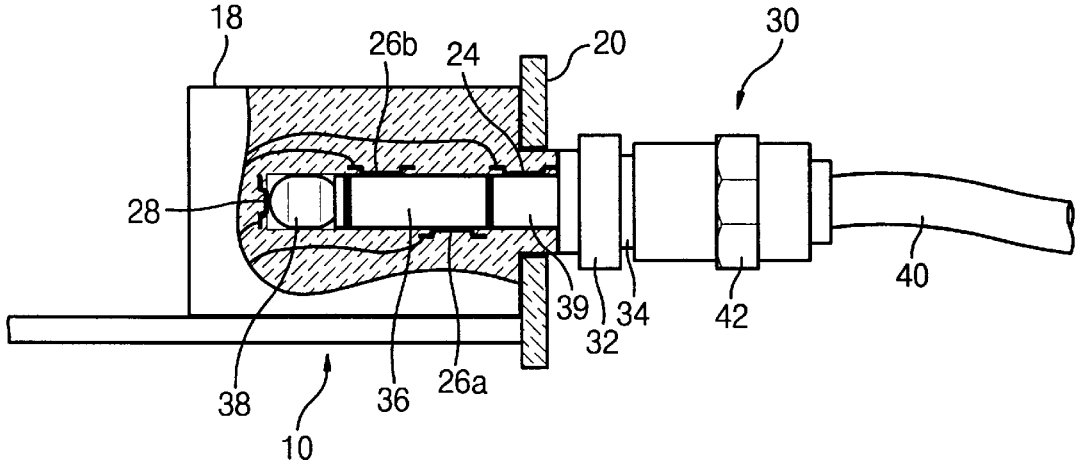
FIG. 4B is a partially cross sectional view for illustrating a coaxial cable connected to an adapter inserted into the line-in jack according to the present invention.

The coaxial connector 42 is connected with a coaxial cable 40. The adapter 30 is to electrically connect the coaxial connector 42 with the line-in jack 18. The adapter 30 comprises a body part 32, post plug 36, and socket 34. The socket 34 is paired with the coaxial connector 42, and the post plug 36 with the line-in jack 18. The post plug 36 is shaped in the form of a conventional audio plug 60 for a phono connector, but longer than the audio plug 60. The post plug 36 has first and second contact zones 38 and 39. The first contact zone 38 is formed on the tip 36*a* of the post plug 36, and the second contact zone 39 on the base of the post plug 36. Hence, inserting the post plug 36 into the plug insertion hole 22, the first contact zone 38 contacts the tuner input contact 28, and the second contact zone 39 the GND contact 24, as shown in FIG. 4B. The socket 34 is provided in the other end part of the body part 32. The socket 34 is connected with the coaxial connector 42. The socket 34 is electrically connected with the post plug 36 through conductor wires 44.

As described above, the inventive structure is characterized in that the common line-in jack is provided with the additional tuner input contact to receive the tuner input together with the audio input, and the adapter is additionally provided to electrically connect the coaxial connector with the line-in jack. As shown in FIG. 4A, inserting the audio input plug 60 into the plug insertion hole 22 of the line-injack 18, the contact zones 62, 64, 66 of the audio input plug 60 respectively contact the GND contact 24, and left and right audio input contacts 26*a* and 26*b*. Meanwhile, the coaxial connector 42 is connected with the socket 34 of the adapter 30 whose post plug 36 is connected with the line-in jack 18 of the audio board 10. In this case, the first contact zone 38 of the post plug 36 contacts the tuner input contact 28, and the second contact zone 39 the GND contact 24.

While the present invention has been described in connection with specific embodiments accompanied by the attached drawings, it will be readily appreciated by those skilled in the art that various changes and modifications may be made thereto without departing the gist of the present invention.

What is claimed is:

1. A connector assembly for an audio board, comprising:

a common line-injack accepting an audio stereo plug and phono connection post plug in the alternative, said post plug being longer than said audio stereo plug, said common line-in jack comprising:

a plug insertion sleeve;

a ground contact located in the plug insertion sleeve in position to contact a ground contact zone of said audio stereo plug;

a first audio input contact located in a first side of the plug insertion sleeve in position to contact first audio input contact zone of said audio stereo plug;

a second audio input contact located in a second side of the plug insertion sleeve position to contact a second audio input contact zone of said audio stereo plug; and a tuner input contact located deeper in said plug insertion sleeve than said first or second audio input contact.

2. The connector assembly of claim 1, further comprising said tuner input contact located in the bottom of said plug insertion sleeve, contacting a tip of said phono connection post plug inserted into said common line-in jack.

3. The connector assembly of claim 1, further comprising:

an adapter connecting a coaxial cable to the common line-in jack, said adapter comprising:

the phono connection post plug, comprising:

a first contact zone contacting said tuner input contact when said post plug is inserted in the common line-in jack; and a second contact zone contacting said ground contact when said post plug is inserted in the common line-in jack.

4. The connector assembly of claim 3, further comprising:

said first contact zone being formed as a tip of the post plug.

5. The connector assembly of claim 3, said post plug further comprising:

a middle contact zone located between the first and the second contact zones contacting said first audio input contact and said second audio input contact when said post plug is inserted in the common line-in jack.

6. The connector assembly of claim 3, said adapter further comprising:

a coaxial connector connecting said post plug to the coaxial cable.

7. The connector assembly of claim 3, said adapter further comprising:

a body part connected to the post plug; and a socket connected to the body part, said socket engaging a coaxial connector.

8. The connector assembly of claim 7, said adapter being an integral unit.

9. The connector assembly of claim 7, further comprising:

the coaxial connector engaging said socket; and the coaxial cable attached to said coaxial connector.

10. An audio card of a personal computer, comprising a microphone-in jack;

a line-out jack;

a headphone-out jack; and a common line-in jack accepting an audio stereo plug and a phono connection post plug in the alternative, said post plug being longer than said audio stereo plug said common line-in jack comprising:

a plug insertion sleeve;

a ground contact located in the plug insertion sleeve in position to contact a ground contact zone of said audio plug;

a first audio input contact located in a first side of the plug insertion in position to contact a first audio input contact zone of said audio stereo plug;

a second audio input contact located in a second side of the plug insertion hole in position to contact a second audio input contact zone of said audio stereo plug; and a tuner input contact located deeper in said plug insertion sleeve than said first or second audio input contract.

11. The audio card of claim 10, further comprising:

said tuner input contact located in the bottom of said plug insertion sleeve, contacting a tip of said post plug inserted into the common line-in jack.

12. The audio card of claim 10, further comprising:

an adapter connecting a coaxial cable to the common line-in jack said adapter comprising:

the phono connection post plug, comprising:

a first contact zone contacting said tuner input contact when said post plug is inserted in the common line-in jack; and a second contact zone contacting said ground contact when said post plug is inserted in the common line-in jack.

13. The audio card of claim 12, further comprising:

said first contact zone being formed as a tip of the post plug.

14. The audio card of claim 12, said post plug further comprising:

a middle contact zone for contacting said first audio input contact and said second audio input contact when said post plug is inserted in the common line-in jack.

15. The audio card of claim 12, said adapter further comprising:

a coaxial connector connecting said post plug to the coaxial cable.

16. The audio card of claim 12, said adapter further comprising:

a body part connected to the post plug; and a socket connected to the body part.

17. The audio card of claim 16, said adapter being an integral unit.

18. The audio card of claim 16, further comprising: coaxial connector engaging said socket; and said coaxial cable attached to said coaxial connector.

19. A process of assembly for an audio board, comprising:

placing a common line-in jack on said audio board;

aligning a sleeve of sad common line-in jack to removably accept alternative insertion of an audio stereo plug and phono connection post plug, with said post plug being longer than said audio stereo plug, locating a ground contact within said sleeve at a position to contact a ground contact zone of said audio stereo plug;

locating a first audio input contact in a first side of said sleeve at a position to contact a first audio input contact zone of said audio stereo plug;

locating a second audio input contact in a second side of said sleeve at a position to contact a second audio input contact zone of said audio stereo plug; and locating a tuner input contact deeper in said sleeve than said first or said second audio input contact.

20. The process of claim 19, further comprised of:

locating said second audio input contact within said sleeve to contact a most distal portion of said audio stereo plug; and locating said tuner input contact within said sleeve to contact a most distal portion of said phono connection post plug.

* * * * *